United States Patent [19]

Fedorchak

[11] Patent Number: 4,760,929

[45] Date of Patent: Aug. 2, 1988

[54] SPACER FOR GARMENT HANGER OR THE LIKE

[76] Inventor: James J. Fedorchak, 75 Old Orchard, Williamsville, N.Y. 14221

[21] Appl. No.: 4,870

[22] Filed: Jan. 20, 1987

[51] Int. Cl.[4] ..... A47F 5/00

[52] U.S. Cl. ..... 211/123; 211/105.1

[58] Field of Search ..... 211/113, 123, 105.1, 211/105.2, 105.3; 248/74.2, 231.8

[56] References Cited

U.S. PATENT DOCUMENTS

| | | | |
|---|---|---|---|
| 1,324,180 | 12/1919 | Shupp | 211/7 |
| 2,868,389 | 1/1959 | Friend | 211/123 |
| 2,895,618 | 7/1959 | Nathan | 211/123 |
| 3,253,084 | 5/1966 | Taylor | 248/74.2 X |
| 4,361,241 | 11/1982 | Stoddard | 211/123 |
| 4,548,328 | 10/1985 | Brauning | 211/123 X |

*Primary Examiner*—Robert W. Gibson, Jr.
*Attorney, Agent, or Firm*—Frank B. Robb

[57] ABSTRACT

A sleeve-like body removably emplaceable upon a supporting rod or the like, which body is provided with a series of elements to position garment hangers or the like in predetermined spaced relation.

1 Claim, 1 Drawing Sheet

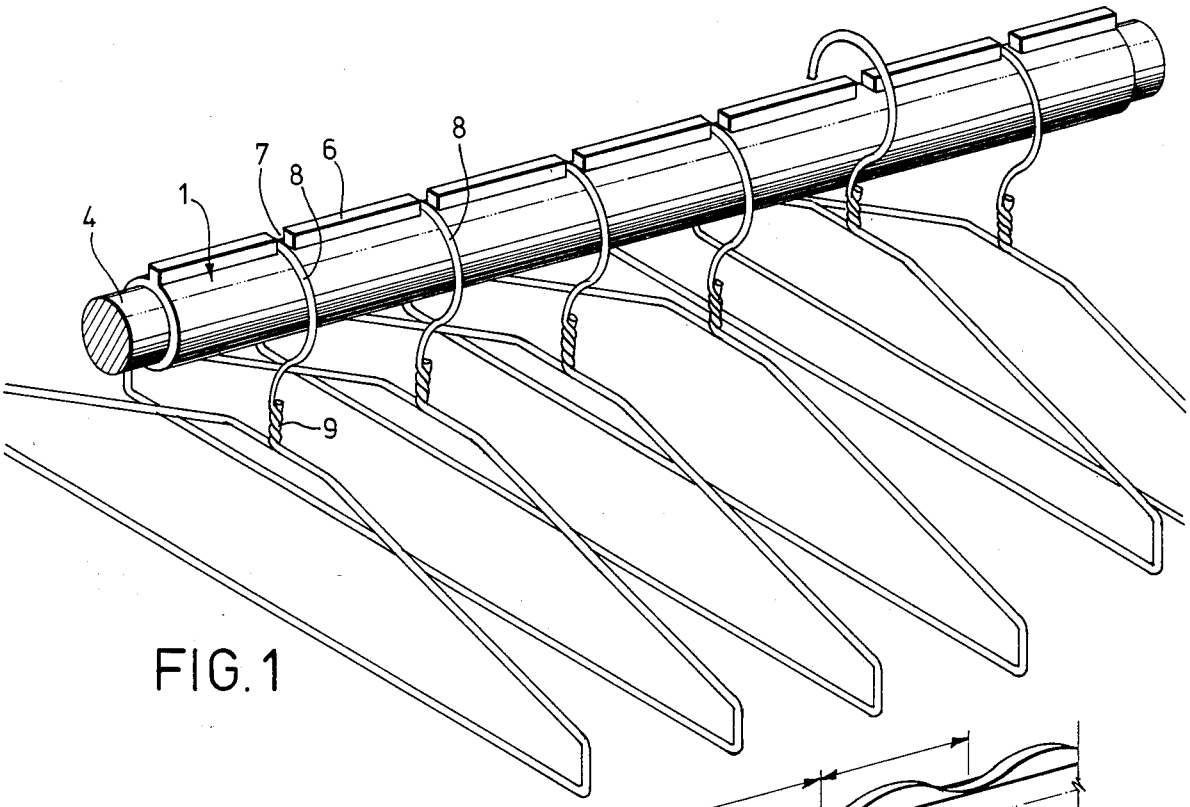
FIG. 1
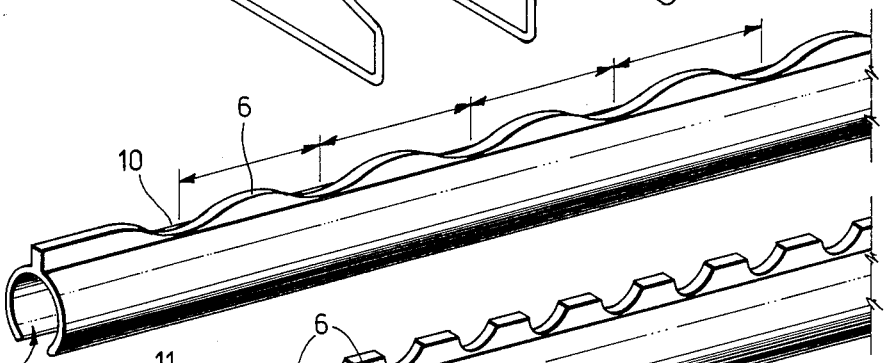
FIG. 2
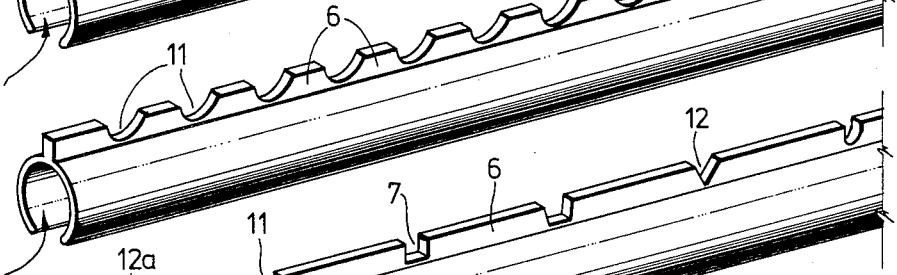
FIG. 3
FIG. 4
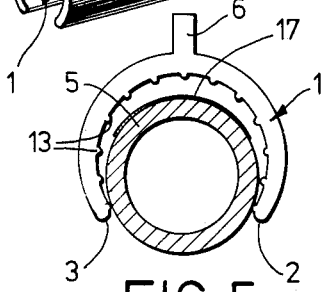
FIG. 5
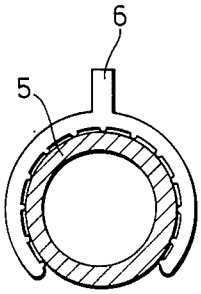
FIG. 6
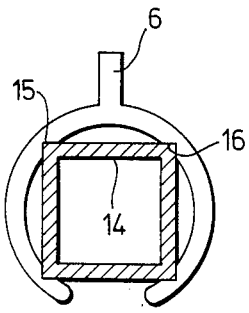
FIG. 7

SPACER FOR GARMENT HANGER OR THE LIKE

BACKGROUND OF THE INVENTION

The invention hereof is one which is intended for use in connection with hanging garments or the like on rods of the usual kind and is intended to provide for positioning such garments as they are in the suspended position along a rod for purposes such as storage or otherwise.

I am not familiar with any prior devices or means for effecting the purposes as heretofore suggested and the concept of separating hanging garments or the like is contemplated hereby. It is frequently the case that garments become bunched for one reason or another and it is often very desirable to maintain them in spaced relation as for example when the garments or hanging items have decorations which might be damaged or affected by bunching and uneven location. It is also contemplated that in manufacture or processing of garments for example it will often be necessary to maintain them in such spaced relation as is contemplated by this invention.

The invention will be found most useful where garments or the like are to be supported on a rod or similar part, and thus some of the unique aspects of the concept will be most useful.

DETAILS OF THE INVENTION

The invention hereof is disclosed as comprising a body of generally tubular form which may have a variety of different spacing elements provided thereon, so that the body can be used in different locations and is adapted further to be positioned on or removed from a rod or the like which would normally support the same.

The disclosure of the various forms of the concept herein is set forth in the application appended hereto and disclosed in the drawing wherein:

FIG. 1 is a general view in perspective showing the invention hereof as supported on a rod and with a series of common hangers positioned and spaced thereby.

FIG. 2 is a fragmentary portion of a spacer body, with a different form of spacer element provided thereby for whatever purpose may be desired and to facilitate movement of hangers from one position to another.

FIG. 3 is a further form of spacer body, wherein a different basis for positioning or spacing the garments is provided and positive location is involved.

FIG. 4 is a body such as shown in FIG. 1 with a little different form of spacer element provided thereby in one or two instances as examples.

FIG. 5 is an end view, partly in section showing the body as being introduced onto the support rod or the like which is intended to bear the same in its spacing action.

FIG. 6 shows the body as in FIG. 5 but in fully engaged position and maintained in that position by frictional engagement of the body with the rod.

FIG. 7 is a potentially different form of body, where a rod of rectangular configuration is provided to positively prevent displacement rotationally of the spacer body.

Turning now to a consideration of the drawing, FIG. 1 is a basic form of the invention wherein a spacer body of generally tubular configuration designated 1, is provided, the body being shown in end view in FIG. 5 and 6 as having a sleeve-like form, with a slot extending throughout its length, formed by the absence of the material between the edges 2 and 3 of the body 1.

This slot provided by the edges 2 and 3 is such as to enable the body as a whole to be slipped over a main support rod designated 4, which may be of solid or hollow configuration, the rod in FIG. 5 being designated 5 and of hollow tubular form.

The body 1 is formed of material which is obviously such as to permit flexing sufficiently to separate the edges 2 and 3 of the slot and thus make possible slipping of the body 1 as a whole over the rod or from end to end as may be desired.

The body 1 is shown in FIG. 1 as having a ridge-like formation or portion extending upwardly, designated 6 in this instance, which in cross-section is generally rectangular and elongated so as to extend along the entire body 1, and having a series of notches or elements 7 in which the hook portions 8 of hangers such as 9 may be located.

The body 1 is of any preferred length so that it is easily manipulable and it can be provided as a series of such bodies for a long rod or for spaced positions on such rod, as well as making room for any given number of hangers to be suspended and spaced thereon.

The the ridge-like formation 6 as shown in FIG. 2, is formed with a wave-like configuration as positioning elements 10, which will make possible the movement of hangers or the like from location to location with sliding movement, and will not require the raising of the hanger and whatever is suspended therefrom. This is in contrast to the disclosure in FIG. 1, wherein the notches are more positive in their locating action. The notches necessarily require that the hanger be raised to re-position the same.

FIG. 4 discloses several different forms of notches on the same body by way of illustration such as the notch **12*a* for example along with a notch like 7, another form 11 also being disclosed. The v-like form of notch 12** may have some special application, or facilitate the positioning of a different form of hanger or the like.

It is thus apparent that suitable spacing means are provided for garment hangers or similar supporting devices, the same basic concept being useful therefore.

It is possible that during certain manufacturing procedures, spacing of elements for engagement of comparable parts such as the hangers illustrated, and during manufacture of clothing the invention may be particularly useful.

The use of the concept in the separation of clothing in the usual closet environment is also obviously within the purview of the disclosure.

It is to be understood that the body 1, is or may preferably be formed with a series of longitudinal ridges interiorly so as to provide for the desired gripping action and limit the tendency, if any, of the body to rotate on the support rod.

It may be that a square rod is provided for the support, in which case the interior of the body 1 may be formed so as to mate therewith as shown and the longitudinal grooves for such purpose designated 15 for engaging the corners of the rod 14, the corners being designated 16.

If a rod of other cross-sectional shape is used, it is contemplated that the interior of the body 1 may be formed to generally conform to such shape, which may be such as to provide for resistance to rotation.

Under some conditions, double sided tape so-called as shown in FIG. 5, or some comparable material may be positioned on the rod 14 for example, in short or long strips along the rod, and thus engage the interior of the body 1 when the same is positioned on the rod, to resist the possible rotation of the said body.

I claim:

1. Spacer means for a garment hanger or the like, said rod having an exterior surface to be engaged by the spacer means, said means comprising a body of relatively stiff, flexible material formed to be seated on and substantially encircle said rod, said body having a longitudinal slot to facilitate emplacement of the body on such rod, the spacer means further including a ridge-like portion extending along its outer surface having elements to maintain garment hangers or the like in predetermined spaced relation, and a series of gripping elements on the interior surface of the body to grip the hanger rod to limit rotational movement of the spacer means, and maintain the spacer elements in hanger spacing position.

* * * * *